US006941902B2

(12) United States Patent
Jung et al.

(10) Patent No.: US 6,941,902 B2
(45) Date of Patent: Sep. 13, 2005

(54) COOLANT RECOVERY SYSTEM OF A VEHICLE

(75) Inventors: Hee Jong Jung, Jeonju (KR); Byeong Woon Ryu, Jeonrabuk-do (KR)

(73) Assignee: Hyundai Motor Company, Seoul (KR)

( * ) Notice: Subject to any disclaimer, the term of this patent is extended or adjusted under 35 U.S.C. 154(b) by 109 days.

(21) Appl. No.: 10/750,663

(22) Filed: Dec. 31, 2003

(65) Prior Publication Data

US 2005/0066915 A1 Mar. 31, 2005

(30) Foreign Application Priority Data

Sep. 26, 2003 (KR) ..... 10-2003-0066785

(51) Int. Cl.[7] ..... F01P 3/22
(52) U.S. Cl. ..... 123/41.54; 165/51

(58) Field of Search ..... 123/41.54; 165/51

(56) References Cited

U.S. PATENT DOCUMENTS 3,820,593 A * 6/1974 Pabst ..... 123/41.54

FOREIGN PATENT DOCUMENTS

JP 5-64423 8/1993

* cited by examiner

*Primary Examiner*—Noah P. Kamen
(74) *Attorney, Agent, or Firm*—Morgan Lewis & Bockius LLP

(57) ABSTRACT

In a coolant recovery system of a vehicle, a coolant reservoir is connected at its upper portion to a radiator by a first pressure cap and a first ventilation hose, and to an engine by a second ventilation hose that is provided with a check valve thereon.

6 Claims, 3 Drawing Sheets

COOLANT RECOVERY SYSTEM OF A VEHICLE

CROSS-REFERENCE TO RELATED APPLICATIONS

This application claims priority of Korean Application No. 10-2003-0066785, filed on Sep. 26, 2003, the disclosure of which is incorporated fully herein by reference.

FIELD OF THE INVENTION

Generally, the present invention relates to a cooling system of a vehicle. More particularly, the present invention relates to a coolant recovery system for a cooling system of a vehicle for exhausting vapor in the cooling system and for recovering and supplementing coolant thereto.

BACKGROUND OF THE INVENTION

A conventional coolant recovery system includes a coolant reservoir disposed outside of an engine for storing a predetermined amount of coolant. The coolant reservoir is connected to the engine and a radiator by ventilation hoses. Therefore, vapors generated at the engine and the radiator are exhausted to the coolant reservoir through the ventilation hoses.

In addition, the coolant reservoir is also connected to the engine by a coolant supply line, so coolant is supplied to the engine through the coolant supply line when the engine becomes short of coolant.

The coolant reservoir is provided with a pressure cap, and an overflow hose is connected to the pressure cap such that air can be exhausted from the coolant reservoir when internal pressure within the reservoir becomes excessive.

Such a pressure cap of the coolant reservoir can be opened by anybody, so it can be easily lost or loosened.

A conventional coolant reservoir usually has many edges. As a result, different portions of the coolant reservoir receive different stresses due to the internal pressure in the coolant reservoir, and thereby portions receiving the most severe stresses can be easily cracked.

A radiator side ventilation hose connecting the radiator and the coolant reservoir is usually provided with a check valve for preventing reverse flow of air (or coolant) from the coolant reservoir to the radiator.

However, an engine side ventilation hose is not provided with such a check valve. Therefore, air from the coolant reservoir may possibly flow back to the engine through the engine side ventilation hose.

The information disclosed in this Background of the Invention section is only for enhancement of understanding of the background of the invention and should not be taken as an acknowledgement or any form of suggestion that this information forms the prior art that is already known in this country to a person of ordinary skill in the art.

SUMMARY OF THE INVENTION

The motivation for the present invention is to provide a coolant recovery system for a vehicle that prevents reverse flow of vapor, enhances durability of a coolant reservoir, and secures a pressure cap in its closed position.

An exemplary coolant recovery system according to an embodiment of the present invention is adaptable for a vehicle having an engine and a radiator.

Such an exemplary coolant recovery system according to an embodiment of the present invention includes a coolant reservoir having a first pressure cap formed at an upper portion thereof, a first ventilation hose connecting the first pressure cap and the radiator such that vapor from the radiator is supplied to the coolant reservoir through the first ventilation hose when vapor pressure in the radiator exceeds a predetermined pressure of, a second ventilation hose connecting the engine and the upper portion of the coolant reservoir, and a check valve disposed on the second ventilation hose for preventing reverse flow from the coolant reservoir to the engine.

In a further embodiment, the upper portion of the coolant reservoir has a circular cross-section.

In yet another embodiment, a coolant recovery system further includes a second pressure cap disposed at the upper portion of the coolant reservoir.

In still another embodiment, the second pressure cap has a projection portion, and a stopper for preventing rotation of the projection portion is attached to the coolant reservoir.

In another embodiment, a coolant recovery system further includes an overflow hose connected to the second pressure cap.

In yet another embodiment, a predetermined opening pressure of the second pressure cap is equal to or lower than a predetermined opening pressure of the first pressure cap.

BRIEF DESCRIPTION OF THE DRAWINGS

The accompanying drawings, which are incorporated in and constitute a part of the specification, illustrate an embodiment of the invention, and, together with the description, serve to explain the principles of the invention.

DETAILED DESCRIPTION OF THE PREFERRED EMBODIMENTS

An embodiment of the present invention will hereinafter be described in detail with reference to the accompanying drawings.

Figure 1:
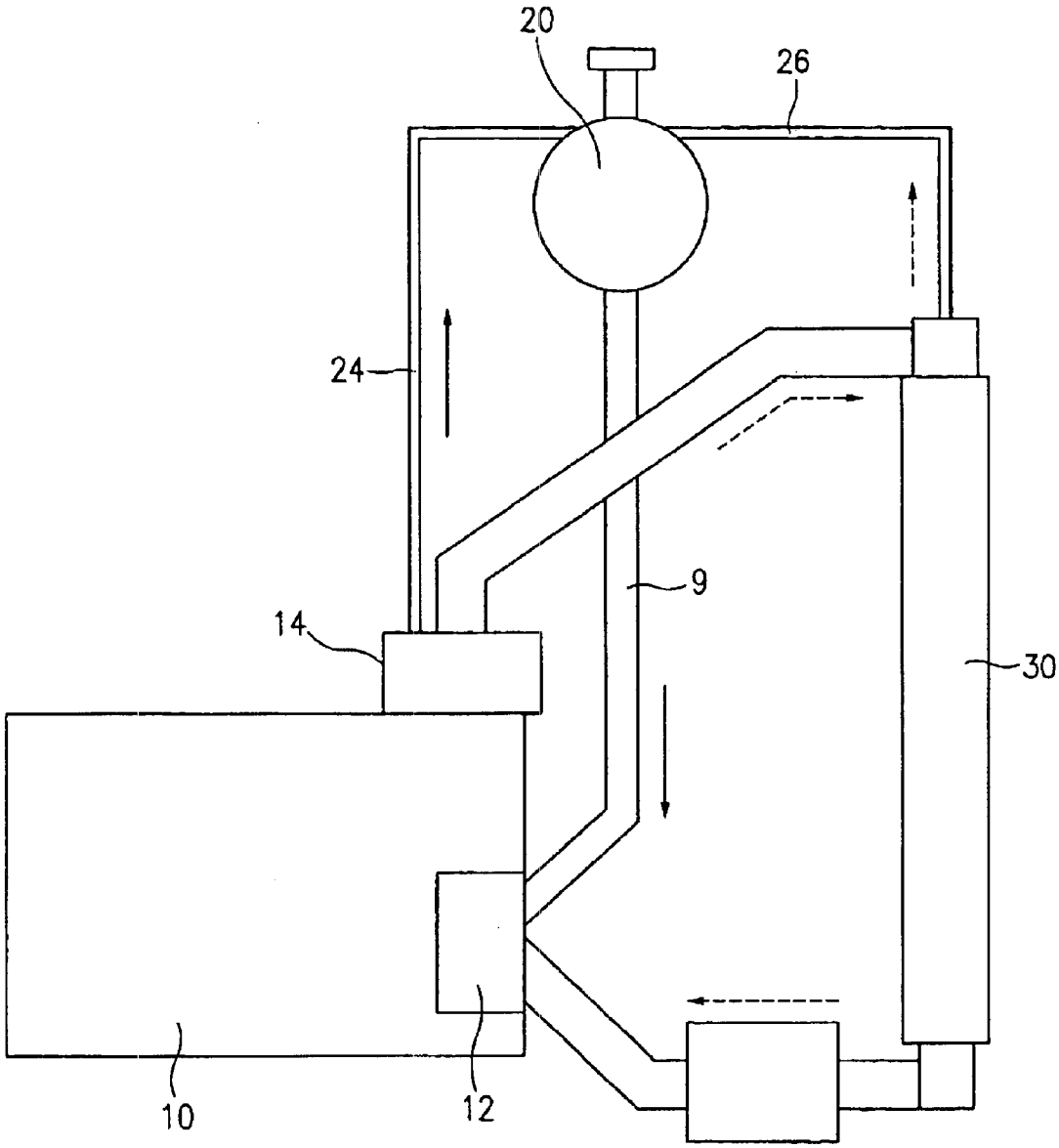
FIG. 1 illustrates a cooling system of a vehicle and a coolant recovery system thereof according to an embodiment of the present invention.

FIG. 1 illustrates a cooling system of a vehicle and a coolant recovery system thereof according to an embodiment of the present invention.

According to an embodiment of the present invention, an engine 10 and a radiator 30 are interconnected by coolant hoses such that coolant can circulate between the engine 10 and radiator 30 through the coolant hoses. The engine 10 is provided with a water pump 12 for forced circulation of the coolant, and a thermostat 14 for controlling the coolant circulation based on coolant temperature.

A coolant reservoir 20 is additionally provided in the cooling system such that air (or vapor) in the cooling system can be exhausted thereto. The coolant reservoir 20 is connected to the engine 10 by an engine side ventilation hose 24 such that air (or vapor) from the engine 10 can be gathered at the coolant reservoir 20. In addition, for gathering air from the radiator 30, the coolant reservoir 20 is also connected to the radiator 30 by a radiator side ventilation hose 26. The coolant reservoir 20 is also connected to the water pump 12 by a coolant supply line 9 such that the cooling system can be refilled when it becomes short of coolant.

In an early period after starting the engine 10, i.e., when the thermostat 14 is not yet open, the coolant circulates within the engine 10 driven by the water pump 12. During this time, vapor formed in the engine 10 is supplied to the coolant reservoir 20 through the ventilation hose 24. The coolant itself can also be supplied to the coolant reservoir 20. Air (or vapor) is captured in the coolant reservoir 20, and the coolant in the coolant reservoir 20 can be fed back to the engine 10 by the coolant supply line 9.

When the coolant temperature increases, the thermostat 14 opens and the coolant in the engine 10 begins circulation between the engine 10 and the radiator 30. In this case, vapor formed in the radiator 30 can be gathered at the coolant reservoir 20 through the radiator side ventilation hose 26.

Accordingly, due to operation of the coolant reservoir 20, the cooling system of a vehicle is filled with the coolant and thereby cooling efficiency is increased.

Figure 2:
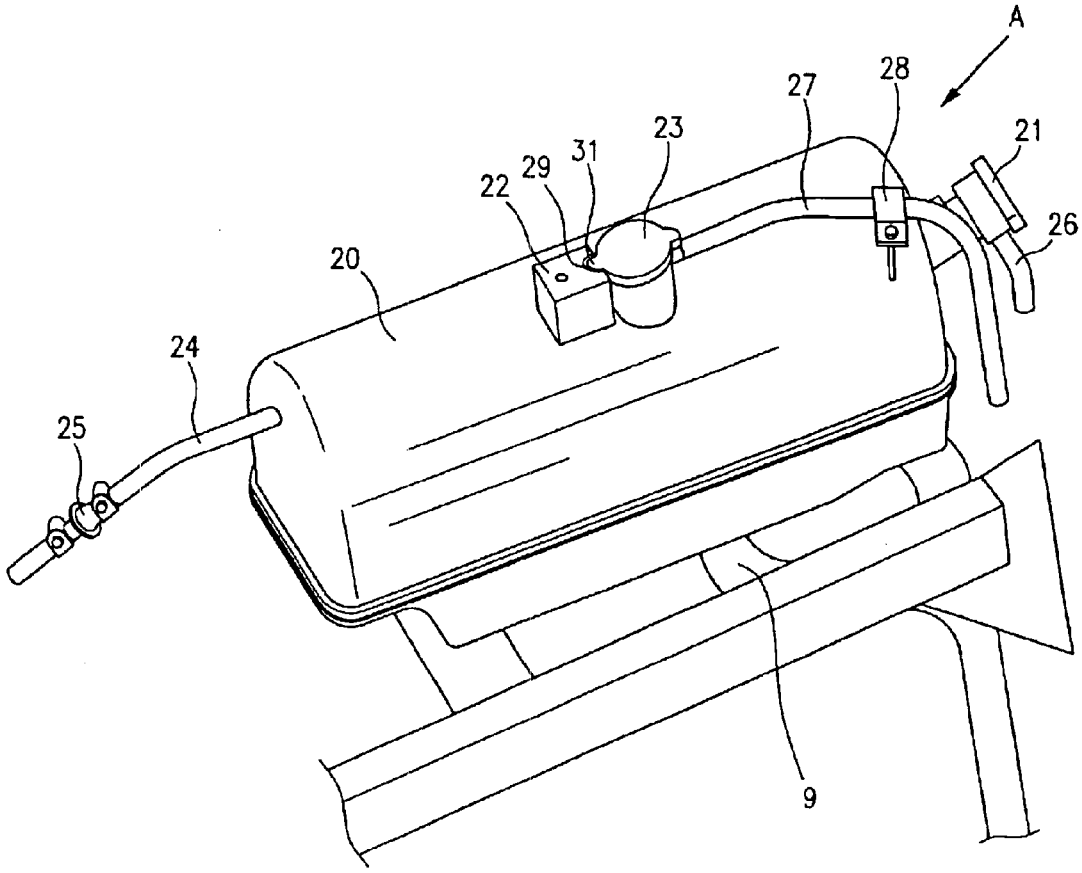
FIG. 2 is a perspective view of a region around a coolant reservoir of a coolant recovery system according to an embodiment of the present invention.
Figure 3:
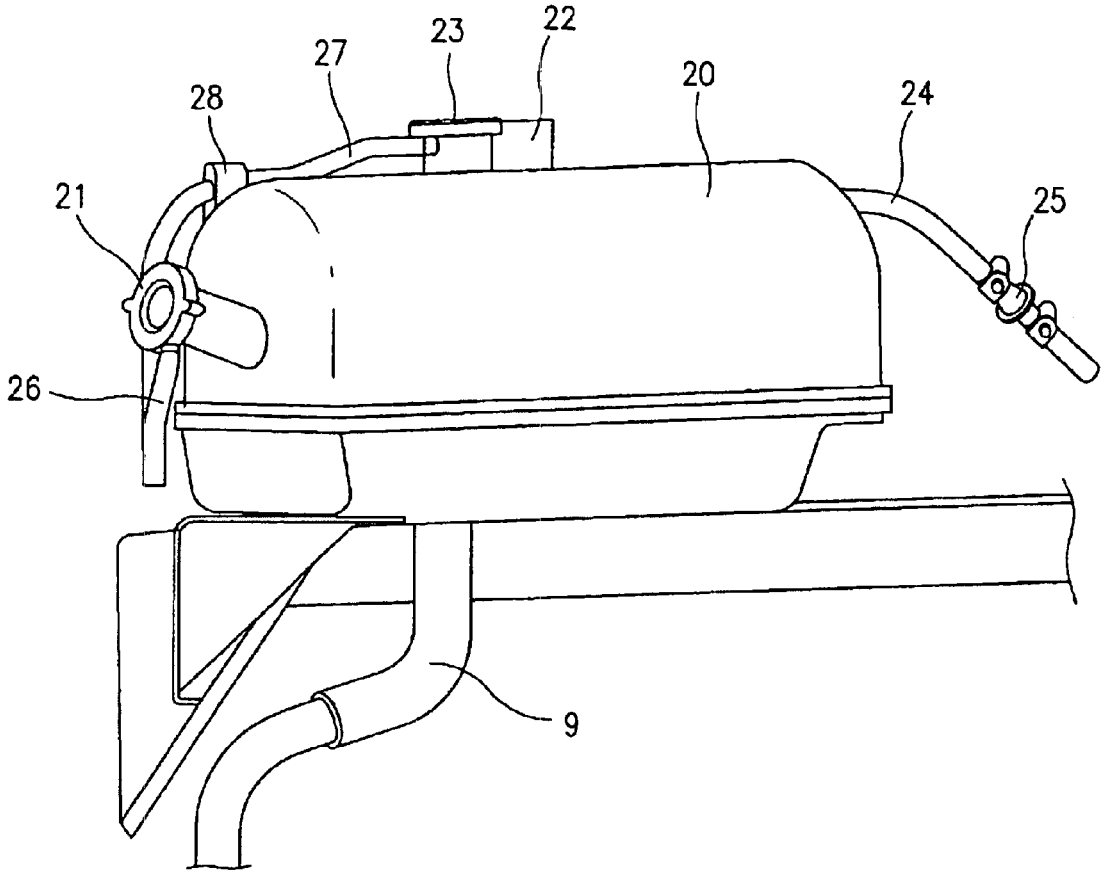
FIG. 3 is a perspective view seen along a line A of FIG. 2.

As shown in FIG. 2, a first pressure cap 21 is formed at an upper portion of the coolant reservoir 20, and a second pressure cap 23 is formed at an uppermost portion of the coolant reservoir 20.

As shown in FIG. 2, the upper portion of the coolant reservoir has a circular cross-section. Therefore, the pressure in the coolant reservoir 20 uniformly acts on each portion of the upper portion of the coolant reservoir 20, eliminating high stress areas.

In this detailed description of an embodiment of the present invention, and also in the appended claims, the term of "upper portion of the coolant reservoir" denotes a portion above 50% of the interior volume of the coolant reservoir 20. That portion of the coolant reservoir 20 below 50% of the interior volume of the coolant reservoir 20 is referred to as a lower portion.

A first ventilation hose 26 (i.e., the radiator side ventilation hose) interconnecting the radiator 30 and the coolant reservoir 20 is connected to the first pressure cap 21. An overflow hose 27 is connected to the second pressure cap 23 such that air can be exhausted from the coolant reservoir 20 when the internal pressure of the coolant reservoir 20 is high.

A predetermined opening pressure of the first pressure cap 21 is hereinafter referred to as a first pressure, and a predetermined opening pressure of the second pressure cap 23 is hereinafter referred to as a second pressure. The second pressure is set equal to or lower than the first pressure.

When vapor pressure in the radiator 30 becomes greater than the first pressure, vapor in the radiator 30 flows into the coolant reservoir 20 through the first ventilation hose 26.

As described above, the first pressure cap 21 is formed at the upper portion of the coolant reservoir 20. Therefore, even if the vapor pressure in the radiator 30 is lower than the internal pressure of the coolant reservoir 20, the vapor in the reservoir 20 does not flow back to the radiator when the internal pressure of the coolant reservoir 20 becomes greater than the first pressure (i.e., the opening pressure of the first pressure cap 21).

According to an embodiment of the present invention, the second pressure (i.e., the opening pressure of the second pressure cap 23) is set equal to or lower than the first pressure (i.e., the opening pressure of the first pressure cap 21). Therefore, while the internal pressure of the coolant reservoir 20 increases, the vapor in the coolant reservoir 20 is exhausted through the overflow hose 27 without flowing back to the radiator 30. This prevents reverse flow of vapor from the coolant reservoir 20 to the radiator 30.

In addition, as described above, a second ventilation hose 24 (i.e., the engine side ventilation hose) is connected to the upper portion of the coolant reservoir 20. A check valve 25 is installed in the second ventilation hose 24 such that vapor flow from the coolant reservoir 20 to the engine 10 is prevented.

A stopper 22 is removably attached to the coolant reservoir 20 in the vicinity of the second pressure cap 23. An indentation 29 is formed at the stopper 22 and it receives a projection portion 31 of the second pressure cap 23. Therefore, rotation of the second pressure cap 23 is prevented by the stopper 22, and accordingly opening of the second pressure cap 23 is prevented.

Therefore, in order to open the second pressure cap 23, the stopper 22 should first be disengaged, preventing easy opening of the second pressure cap 23 at the tope of the coolant reservoir 20. Therefore, the second pressure cap 23 is not easily lost or loosened.

In addition, the overflow hose 27 connected to the second pressure cap 23 is held at the coolant reservoir 20 by a clip 28 such that the overflow hose 27 is not bent. Therefore, exhausting of air from the coolant reservoir 20 is ensured.

According to an embodiment of the present invention, reverse flow of vapor is efficiently prevented in a coolant recovery system.

In addition, durability of a coolant reservoir is enhanced is enhanced due to its simple shape.

In addition, a pressure cap can be secured to its closed position by a stopper, and thereby stable operation of a coolant recovery system is ensured.

While this invention has been described in connection with what is presently considered to be the most practical and preferred embodiment, it is to be understood that the invention is not limited to the disclosed embodiments, but, on the contrary, is intended to cover various modifications and equivalent arrangements included within the spirit and scope of the attached claims.

What is claimed is:

1. A coolant recovery system of a vehicle having an engine and a radiator, the system comprising:

a coolant reservoir having a first pressure cap formed at an upper portion thereof;

a first ventilation hose connecting the first pressure cap and the radiator such that vapor from the radiator is supplied to the coolant reservoir through the first ventilation hose when vapor pressure in the radiator becomes greater than a predetermined pressure of the first pressure cap;

a second ventilation hose connecting the engine and the upper portion of the coolant reservoir; and a check valve disposed on the second ventilation hose for preventing reverse flow from the coolant reservoir to the engine.

2. The coolant recovery system of claim 1, wherein the upper portion of the coolant reservoir has a circular cross-section.

3. The coolant recovery system of claim 2, further comprising a second pressure cap disposed at the upper portion of the coolant reservoir.

4. The coolant recovery system of claim 3, wherein:

the second pressure cap comprises a projection portion; and a stopper for preventing rotation of the projection portion is attached to the coolant reservoir.

5. The coolant recovery system of claim 3, further comprising an overflow hose connected to the second pressure cap.

6. The coolant recovery system of claim 5, wherein a predetermined opening pressure of the second pressure cap is equal to or lower than a predetermined opening pressure of the first pressure cap.

* * * * *